US009103626B1

(12) United States Patent
Heizer et al.

(10) Patent No.: US 9,103,626 B1
(45) Date of Patent: Aug. 11, 2015

(54) FIREARM HAVING AMMUNITION COMPARTMENT WITH H-CLIP AND QUICK-CHANGE BARREL WITH VARIABLE DIAMETER BORE AND OPTIONAL TAKEDOWN PIN

(71) Applicant: Heizer Defense, LLC, Pevely, MO (US)

(72) Inventors: Charles K. Heizer, St. Louis, MO (US); Thomas C. Heizer, St. Louis, MO (US)

(73) Assignee: Heizer Defense, LLC, Pevely, MS (US)

( * ) Notice: Subject to any disclaimer, the term of this patent is extended or adjusted under 35 U.S.C. 154(b) by 50 days.

(21) Appl. No.: 13/741,549

(22) Filed: Jan. 15, 2013

Related U.S. Application Data

(63) Continuation-in-part of application No. 13/616,462, filed on Sep. 14, 2012, now Pat. No. 8,915,174, and a continuation-in-part of application No. 13/620,800, filed on Sep. 15, 2012, now Pat. No. 8,915,003, and a continuation-in-part of application No. 13/662,506, filed on Oct. 28, 2012.

(51) Int. Cl.

| | |
|---|---|
| ***F41A 9/45*** | (2006.01) |
| ***F41A 9/83*** | (2006.01) |
| ***F41C 23/22*** | (2006.01) |
| ***F41A 3/00*** | (2006.01) |

(52) U.S. Cl.
CPC .. *F41C 23/22* (2013.01); *F41A 3/00* (2013.01)

(58) Field of Classification Search
CPC ..... F41A 9/35; F41A 9/45; F41A 9/83; F41A 9/84; F41A 21/06; F41A 23/10; F41A 23/22
USPC ..... 42/6, 69.01, 69.02, 69.03, 71.01, 72, 42/75.02, 75.04, 78; 89/1.41, 64
See application file for complete search history.

(56) References Cited

U.S. PATENT DOCUMENTS

| | | | | |
|---|---|---|---|---|
| 36,925 | A * | 11/1862 | Wesson | 42/40 |
| 452,126 | A * | 5/1891 | Torkelson | 42/40 |
| 889,279 | A * | 6/1908 | Warnant | 89/196 |

(Continued)

OTHER PUBLICATIONS

Ranch Moon Clip Combo Package, MidwayUSA, Inc. [online], 2013 [retrieved on Jan. 12, 2013]. Retrieved from the Internet: <URL: http://www.midwayusa.com/product/782664/ranch-moon-clip-combo-package-45-acp-governor-6-round-and-2-round-blue-package-of-8>.

(Continued)

*Primary Examiner* — Bret Hayes
*Assistant Examiner* — Derrick Morgan
(74) *Attorney, Agent, or Firm* — CreatiVenture Law, LLC; Dennis JM Donahue, III

(57) ABSTRACT

A firearm has a frame with an interchangeable barrel that is mounted to the frame through a tool-less knockdown pin. The barrel has ports in a smooth-bore section and no ports in a rifled-bore section, and the ports are progressively spaced, with the ports closest to the rifled-bore section having a greater distance between the ports than the ports closest to the muzzle. Preferably, the firearm is a multi-chamber design such as a revolver with a firing cylinder or a multi-barrel breech-loader that holds multiple rounds of ammunition together with a storage-firing clip while stored in an ammunition compartment and also when loaded into the firing chambers and discharged by the firearm. The frame preferably has a trigger mechanism with a sear assembly that includes a block assembly with a wedge block that translates on a guide rod and a disconnect block that is supported by a disconnect rest.

20 Claims, 6 Drawing Sheets

(56) References Cited

U.S. PATENT DOCUMENTS

| | | | | | |
|---|---|---|---|---|---|
| 923,068 | A | | 5/1909 | Neal | |
| 1,183,115 | A | * | 5/1916 | Reising | 89/137 |
| 1,231,106 | A | * | 6/1917 | Wesson | 42/89 |
| 1,395,141 | A | * | 10/1921 | Reising | 89/145 |
| 1,427,413 | A | * | 8/1922 | Pieper | 89/196 |
| 2,215,726 | A | | 5/1933 | Masterton-Smith | |
| 2,197,313 | A | * | 4/1940 | Nomar | 42/88 |
| 2,447,891 | A | * | 8/1948 | Arrowsmith | 42/34 |
| 2,509,553 | A | | 5/1950 | Wylie | |
| 2,805,507 | A | | 9/1957 | Buquor | |
| 3,525,172 | A | * | 8/1970 | Costa et al. | 42/78 |
| 3,722,125 | A | | 3/1973 | Switzer | |
| 3,808,943 | A | | 5/1974 | Kelly | |
| 4,008,538 | A | * | 2/1977 | Center | 42/78 |
| 4,155,187 | A | * | 5/1979 | Lichtman | 42/11 |
| 4,400,900 | A | * | 8/1983 | Hillberg et al. | 42/69.01 |
| 4,400,901 | A | * | 8/1983 | Hillberg | 42/70.08 |
| 4,407,085 | A | * | 10/1983 | Hillberg et al. | 42/69.01 |
| 4,424,638 | A | * | 1/1984 | Hillberg | 42/69.01 |
| 4,437,252 | A | * | 3/1984 | Castellanos Manero | 42/89 |
| 4,472,901 | A | * | 9/1984 | Hillberg et al. | 42/71.02 |
| 4,507,889 | A | | 4/1985 | Allen | |
| 4,527,348 | A | * | 7/1985 | Brennan | 42/76.01 |
| 4,535,558 | A | * | 8/1985 | Benesh | 42/89 |
| 4,577,429 | A | * | 3/1986 | Waiser | 42/59 |
| 4,651,456 | A | * | 3/1987 | Ghisoni | 42/62 |
| 4,697,368 | A | * | 10/1987 | Williams | 42/71.02 |
| 4,722,148 | A | * | 2/1988 | Walker | 42/69.01 |
| 4,833,810 | A | | 5/1989 | Domian | |
| 4,869,009 | A | | 9/1989 | Bennett | |
| 4,995,179 | A | | 2/1991 | Switzer | |
| 5,113,604 | A | | 5/1992 | Vyprachticky | |
| 5,225,613 | A | * | 7/1993 | Claridge | 42/74 |
| 5,243,895 | A | | 9/1993 | Dickman | |
| H1365 | H | | 11/1994 | Amspacker | |
| 5,421,114 | A | * | 6/1995 | Bond et al. | 42/42.03 |
| 5,490,343 | A | * | 2/1996 | Cory et al. | 42/70.08 |
| 5,587,549 | A | | 12/1996 | Clouse | |
| 5,813,157 | A | * | 9/1998 | Scott et al. | 42/71.01 |
| 5,939,657 | A | * | 8/1999 | Morgado | 89/33.03 |
| 6,164,001 | A | * | 12/2000 | Lee | 42/69.01 |
| 6,557,449 | B1 | * | 5/2003 | O'Dwyer | 89/1.41 |
| 6,854,205 | B2 | | 2/2005 | Wikle | |
| 6,952,896 | B2 | | 10/2005 | Davis | |
| 7,739,821 | B1 | * | 6/2010 | Hamme | 42/8 |
| 7,886,650 | B1 | | 2/2011 | Rosenthal | |
| 7,937,876 | B1 | * | 5/2011 | Graham | 42/75.03 |
| 8,122,635 | B2 | | 2/2012 | Pullicar | |
| 8,495,831 | B1 | * | 7/2013 | Kohout | 42/8 |
| 2001/0016998 | A1 | * | 8/2001 | Chapman | 42/69.01 |
| 2003/0145503 | A1 | * | 8/2003 | Orr | 42/69.01 |
| 2008/0190004 | A1 | * | 8/2008 | Filicietti | 42/71.01 |
| 2010/0139144 | A1 | | 6/2010 | Fitzpatrick | |
| 2011/0072704 | A1 | * | 3/2011 | Teach et al. | 42/8 |
| 2012/0167433 | A1 | | 7/2012 | Robbins | |
| 2012/0174456 | A1 | * | 7/2012 | DePierro et al. | 42/71.01 |
| 2012/0279106 | A1 | * | 11/2012 | Hayes et al. | 42/69.01 |
| 2013/0205632 | A1 | * | 8/2013 | Kohout | 42/8 |

OTHER PUBLICATIONS

Ranch 1/3 Moon Clip, MidwayUSA, Inc. [online], 2013 [retrieved on Jan. 12, 2013]. Retrieved from the Internet: <URL: http://www.midwayusa.com/product/126763/ranch-1-3-moon-clip-45-acp-2-round-blue-package-of-25>.

Moon Clip, Wikipedia. [online], 2013 [retrieved on Jan. 12, 2013]. Retrieved from the Internet: <http://en.wikipedia.org/wiki/Moon_clip>.

Metcalf, Dick; Heizer Defense DoubleTap; Guns & Ammo Magazine; Los Angeles, CA; pp. 54-64; Sep. 2012.

* cited by examiner

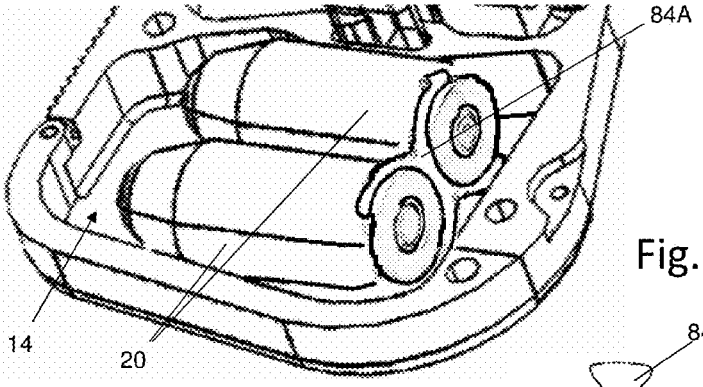
Fig. 6
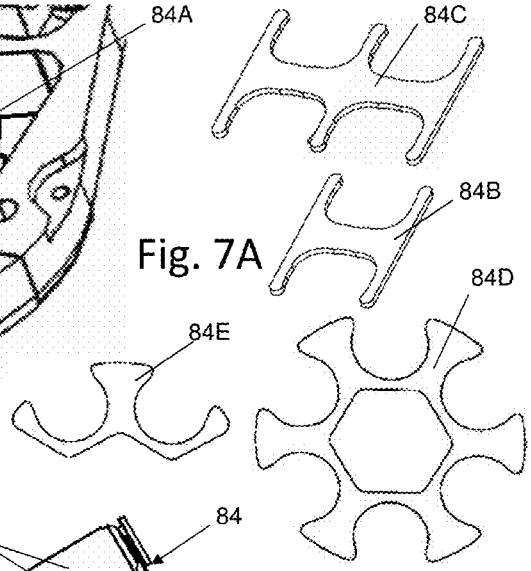
Fig. 7A
Fig. 7B
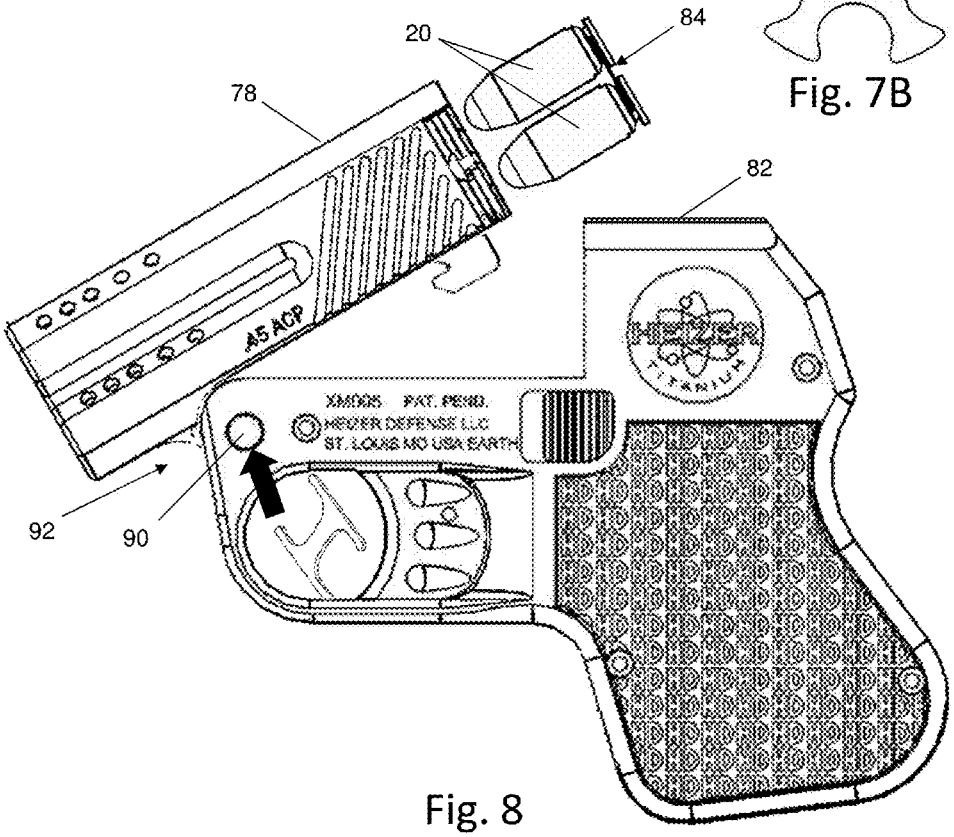
Fig. 8

FIREARM HAVING AMMUNITION COMPARTMENT WITH H-CLIP AND QUICK-CHANGE BARREL WITH VARIABLE DIAMETER BORE AND OPTIONAL TAKEDOWN PIN

CROSS-REFERENCE TO RELATED APPLICATIONS

This application is a continuation-in-part of U.S. patent application Ser. No. 13/620,800, filed on Sep. 15, 2012 and also is a continuation-in-part of U.S. patent application Ser. Nos. 13/616,462 and 13/662,506, respectively filed on Sep. 14, 2012 and Oct. 28, 2012. Each one of the co-pending applications is incorporated by reference herein.

STATEMENT REGARDING FEDERALLY SPONSORED RESEARCH

Not Applicable.

APPENDIX

Not Applicable.

BACKGROUND OF THE INVENTION

1. Field of the Invention

The present invention relates to firearms, and more particularly to firearms with one or more storage chambers or compartments in the firearms' hand grips, forearm stocks or butt stocks and a porting system for the discharge of gases at points along the length of the barrel when the ammunition is fired, and is particularly suited for firearms with multiple firing chambers for the ammunition.

2. Related Art

Hand grips, forearm stocks and butt stocks for guns have been known to include compartments for items, such as ammunition, batteries, cleaning tools, knife blades and other gear and equipment that may be used with a firearm or apart from the firearm. Some compartments are specially formed for ammunition, having individual holes for each round such as in U.S. Pat. No. 2,509,553 or a tube for a series of rounds such as in U.S. Pat. No. 6,952,896. Other compartments can be attached to the handle of the firearm but are separate from the handle and are not located within the handle itself such as in U.S. Pat. No. 4,697,368 which has a speedloader cartridge holder secured within a separate storage compartment that is secured to the butt of a firearm. Other compartments are merely cavities formed within the hand grip without any internal structure to secure the cartridges together within the cavity, such as in U.S. Pat. No. 2,805,507 which indicates that an inwardly facing blade separates two rows of cartridges but it does not secure the cartridges together within the internal cavity. Each of the prior art references are hereby incorporated by reference herein.

Firearms typically experience recoil and muzzle climb due to discharge gases when the firearm is fired. Recoil is created by a forward momentum of the bullet and results in a rearward acting force upon the firearm and the shooter. Additionally, muzzle climb creates an upward movement of the barrel when firing the firearm. Recoil and muzzle climb typically increase with the size of the bullet or projectile. Moreover, the weight of the firearm may also increase recoil and muzzle climb. Recoil and muzzle climb may cause shooters to flinch or hesitate when firing the firearm, thereby resulting in lost control of the firearm. Additionally, muzzle climb and recoil may lead to fatigue in the shooter and may inhibit the shooter's ability to fire the firearm long term. Recoil and muzzle climb further cause the firearm to move out of alignment with the target with each shot fired. As such, recoil and muzzle climb greatly decrease the shooters accuracy.

It is generally known to use ports or conduits formed in the barrel of the firearm to direct gas flow from the firearm so that recoil and muzzle climb are reduced. It is also known to provide a larger-diameter smooth bore barrel section following the smaller-diameter rifled bore barrel section to permit the expanding gases to flow past the bullet and reduce the peak pressure in the gun barrel to reduce the pressure adjacent the muzzle as the bullet exits the barrel. The variable-diameter bore can reduce the recoil and also has the benefit of increasing the bullet velocity. However, merely incorporating the traditional ported barrel designs into a variable-diameter bore barrel would not provide the improvements of either feature and could operate against each other, thereby reducing the effectiveness of these features. Accordingly, prior to the present invention, firearms have not been successful in combining the benefits of a ported barrel with a variable-diameter bore in a satisfactory way and a need remains for combining these benefits in a new way. It is also known to use wrenches and other tools that are not functioning parts of the firearm to remove and fasten interchangeable barrels on firearms, and it would be yet another benefit to use a functional feature of the firearm to remove and fasten such interchangeable barrels.

There also remains a need for a storage compartment that is formed as a cavity within the handle of a firearm and which securely stores the rounds of ammunition together. For firearms that have multiple chambers for firing the ammunition, there is also a particular need for a storage compartment which can hold multiple rounds of the ammunition that are secured together by a combined storage-firing clip so that the ammunition can be loaded into the firing chambers in the same arrangement in which they are stored and fired without having to remove the clip holding the rounds together.

BRIEF DESCRIPTION OF THE DRAWINGS

The present invention will become more fully understood from the detailed description and the accompanying drawings.

FIG. 6 is a cutaway perspective view of the grip with a storage-firing clip.

FIGS. 7A and 7B respectively show perspective views and plan views of alternative storage-firing clips.

FIG. 8 is a side view of the firearm with an open barrel for loading cartridges secured together by a storage-firing clip.

DETAILED DESCRIPTION OF THE PREFERRED EMBODIMENTS

The following description of the preferred embodiment(s) is merely exemplary in nature and is in no way intended to limit the invention, its application, or uses.

Figure 1:
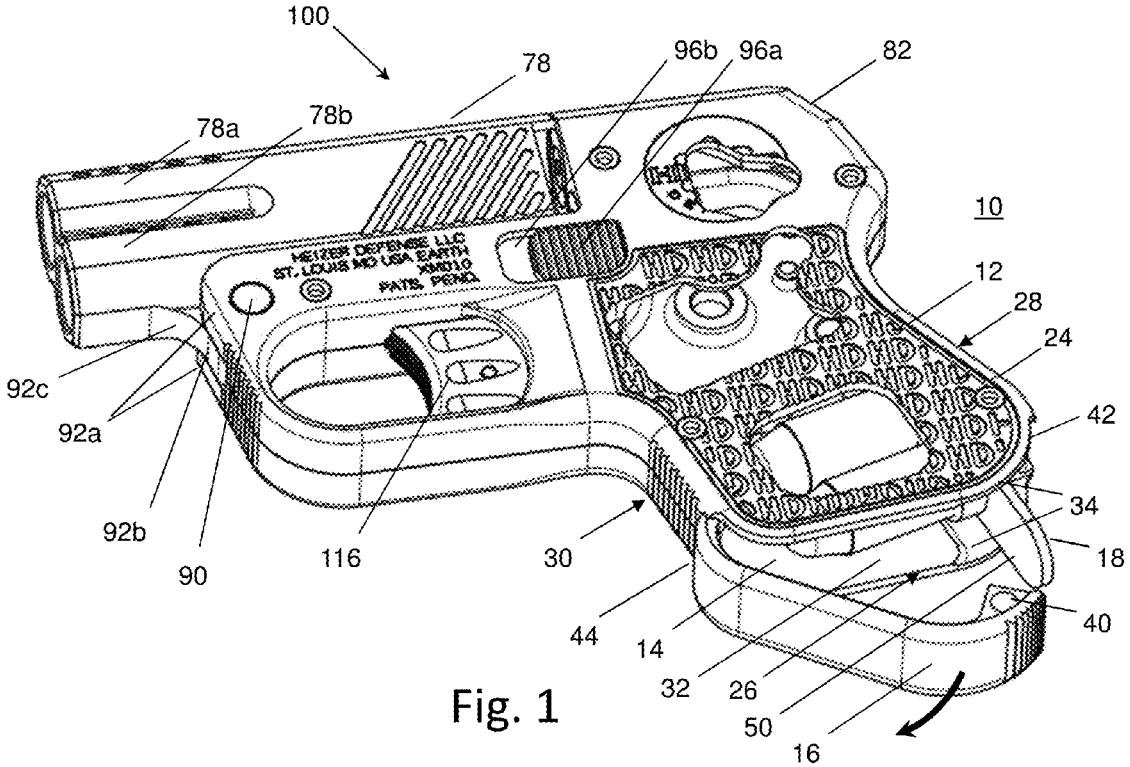
FIG. 1 is a perspective view of a firearm with a partial cutaway of the grip.

The present invention relates to the handle 10 of a firearm 100. The handle 10 has an outer grip 12, an inner compartment 14 and a door 16 fitted therebetween. An ammunition strip clip 18 slides into one end of the inner compartment 14 and securely holds cartridges 20 within the compartment. FIG. 1 shows a perspective view of the firearm 100 with a partial cutaway of the grip 12 which reveals the ammunition 20 mounted on the strip clip 18 within the storage compartment 14.

The outer grip 12 portion of the handle 10 has a pair of opposing side walls 22, an end wall 24 between the side walls 22, and an open section 26 that is between the side walls 22 and is adjacent to the end wall 24. In the preferred embodiment, the end wall 24 is located at the palm side 28 of the grip 12 at one side of the open section 26*a*. The finger side 30 of the grip 12 is at an opposite side of the open section 26*b*.

Figure 2:
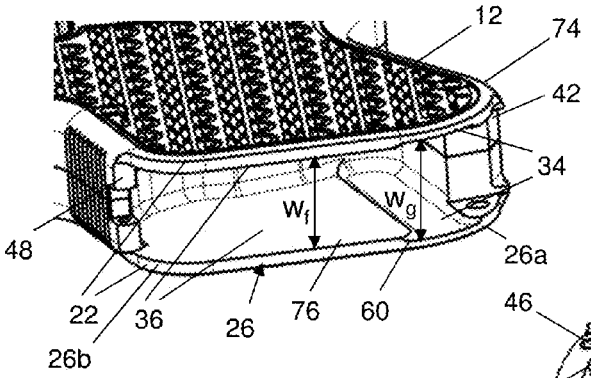
FIG. 2 is an interior view of the grip.

The ammunition storage compartment 14 has a cavity 32 and a pair of opposing grooves 34. The cavity 32, shown in FIG. 2 with the door removed and empty (i.e., without the strip clip 18 or ammunition 20), is situated between the side walls 22 and the end wall 24. The grooves 34 are formed in opposing inner faces 36 of the side walls 22. The grooves extend from the open section 26 into the cavity 32. The compartment width as measured between the grooves ($w_g$) is wider than the compartment width as measured between the between the faces without grooves ($w_f$). As described in more detail below, the grooves 34 help secure the ammunition 20 within the cavity 32 by holding the strip clip 18 in place, and the strip clip 18 holds the cartridges 20. The inner compartment 14 has an inner wall 38 extending into the cavity 32 from the open section 26, and the grooves 34 extend into the cavity along the inner wall. In the preferred embodiment, the inner wall 38 is the interior side of the end wall 24.

Figure 3:
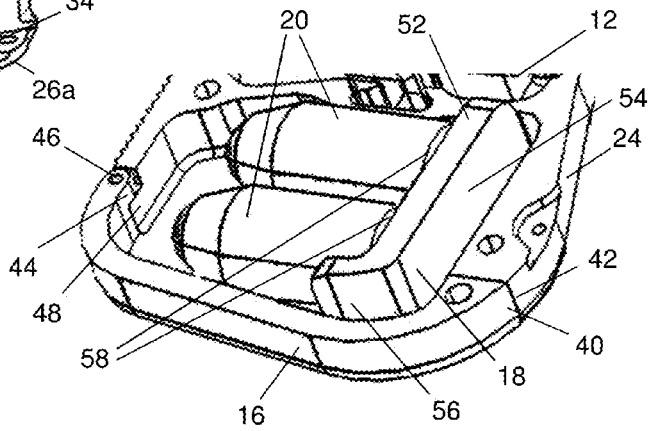
FIG. 3 is a cutaway perspective view of the grip.

The door 16 has an open position as shown in FIG. 1 (partially open) and a closed position as shown in FIG. 3. In the open position, one end of the door 16*a* is swung away from the open section 26, and in the closed position, the door covers the open section 26. The distal end 16*a* of the door has a latch 40 that engages a catch 42 in the end wall 24 of the grip 12. The proximate end 16*b* of the door has a hinge bracket 44 and a hinge pin 46 that engage a hinge mount 48 on the grip 12 at the finger side of the open section 26*b*.

As indicated above, the strip clip 18 securely holds the cartridges 20 in the cavity 32 of the ammunition compartment 14 within the grip 12 of the firearm's handle 10. In addition to holding the ammunition in place, the strip clip 18 cushions the primer end of the rounds 20 against the end wall 24. The strip clip 18 has a base 50, a pair of side edges 52, a bottom face 54 and a tab 56. The base 50 has cartridge mounts 58 which are used to secure the ammunition 20 to the strip clip 18. The strip clip 18 is wider than the compartment width ($w_f$) and is approximately as wide as the width between the grooves ($w_g$) so that the side edges 52 securely and slidingly fit into the grooves 34 with the bottom face 54 situated next to the inner wall 38. The tab 56 is preferably formed of a resilient material and extends out of the open section 26 when the door 16 is open and bends within the cavity 32 when the door is closed.

The grooves 34 preferably include a flared segment 60 proximate to the open section 26 so that the tab 56 is held between the flared segment and the door 16 when the door is closed. Also, when the door 16 is closed, the tab 56 bends around the shell 62 of the cartridge that is adjacent to the door. The diameter of the shell 62 is narrower than the width of the strip clip 18 and is approximately as wide as the compartment width ($w_f$), and the wrapping of the tab 56 around the shell 62 provides additional cushioning to the cartridge 20 that is situated next to the door 16.

Figure 4A:
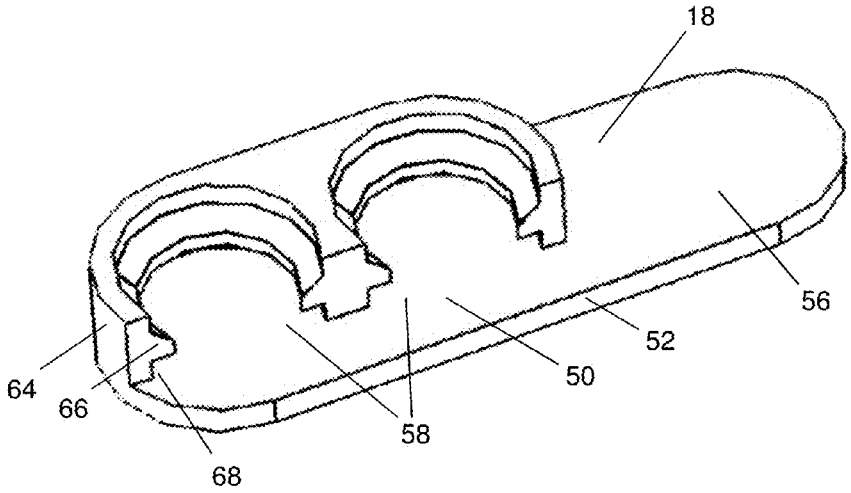
FIGS. 4A-4F are views of strip clips that are used to hold the cartridges.
Figure 4D:
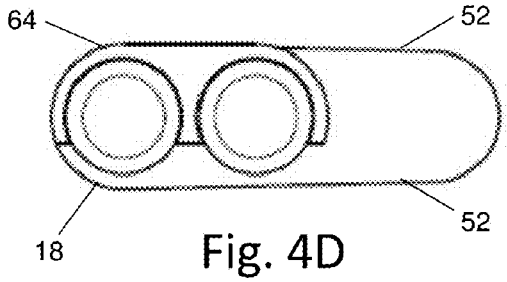
Figure 4B:
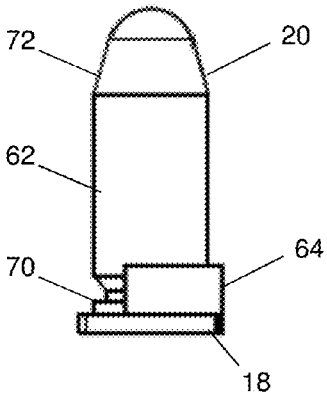
Figure 4C:
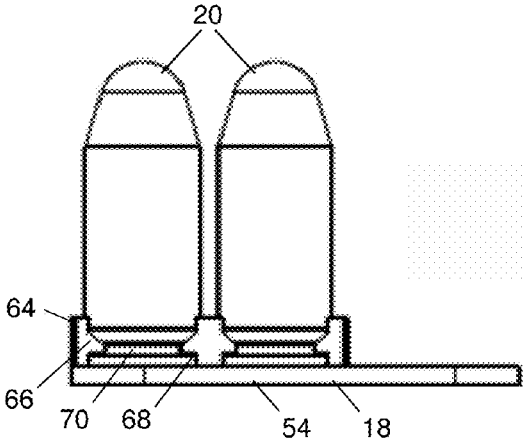
Figure 4E:
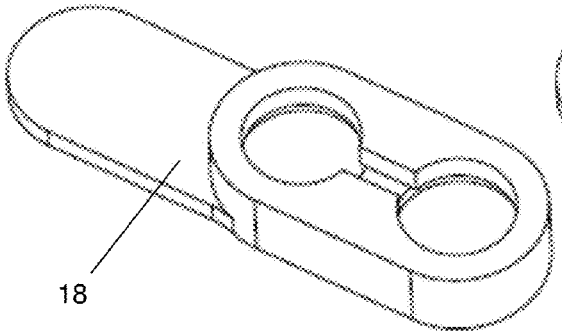
Figure 4F:
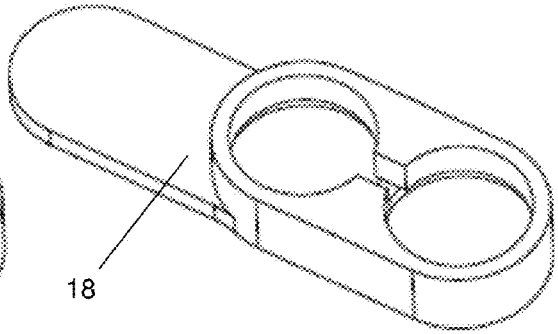

A first embodiment of the strip clip 18 is shown in FIGS. 4A-4D and a second embodiment of the strip clip is shown in FIGS. 4E and 4F. In the first embodiment, the cartridge mounts 58 have a semicircular wall 64 and a flange 66. The flange 66 extends inwardly along the inner surface 68 of the semicircular wall 62 and fits within the rims 70 of the cartridges 20. The semicircular cartridge mounts 58 are arranged adjacent to each other with their walls 64 extending from the base 50 of the strip clip 18. The flange 66 is located between the base 50 and the top of the walls. The flanges form semicircular ridges at the base of the strip clip and the rims of the cartridge fits snugly within this ridge space. It will be appreciated that while the particular speedloader shown in the illustrations is for a design with two shells in a row, other configurations are possible, including configurations which hold more than two shells.

As indicated above, the strip clip 18 is slid into the groove within the compartment 14 so that the tab 56 extends out of the open section 26 when the door is open, and the cartridges 20 are also slid into the cavity with the side of the rounds having the bullet 72 facing away from the end wall 24. It will be appreciated that other strip clip designs could also be used, including the standard design for strip clips 18 in which the cartridge mounts 58 encircle almost the entire base of the shell with a slit between the mounts. The standard design is shown in the second embodiment for different caliber rounds, with a 9 mm cartridge shown in FIG. 4E and a 45 ACP cartridge shown in FIG. 4F. The outer dimensions of the strip clips 18 are the same so that they both securely fit within the compartment 14 while holding their respective caliber rounds. The width of the tabs 56 for these strip clips 18 is slightly narrower than the width of the base 50.

In the preferred embodiment, the open section 26 and the door 16 are located at the butt 74 of the handle 10, and the grooves extend into the handle from the open section so the strip clip 18 slides into the grooves 34. It will also be appreciated that, depending on the depth of the cavity 32 and the calibers of ammunition to be stored in the compartment 14, the grooves 34 could be machined along the edge 76 of the open section 26 so that the strip clip 18 may have a snap-fit engagement or other type of secure fitting with the grooves. Also, while the strip clip 18 is preferably made from a resilient material, more rigid materials could be used, and rather than having a resilient tab that unfolds to extend from the handle, the strip clip could have a notch or a lip that is used for pulling the strip clip out from the cavity or the strip clip may have a hinged tab. These variations in design are within the overall scope of the present invention.

Figure 5:
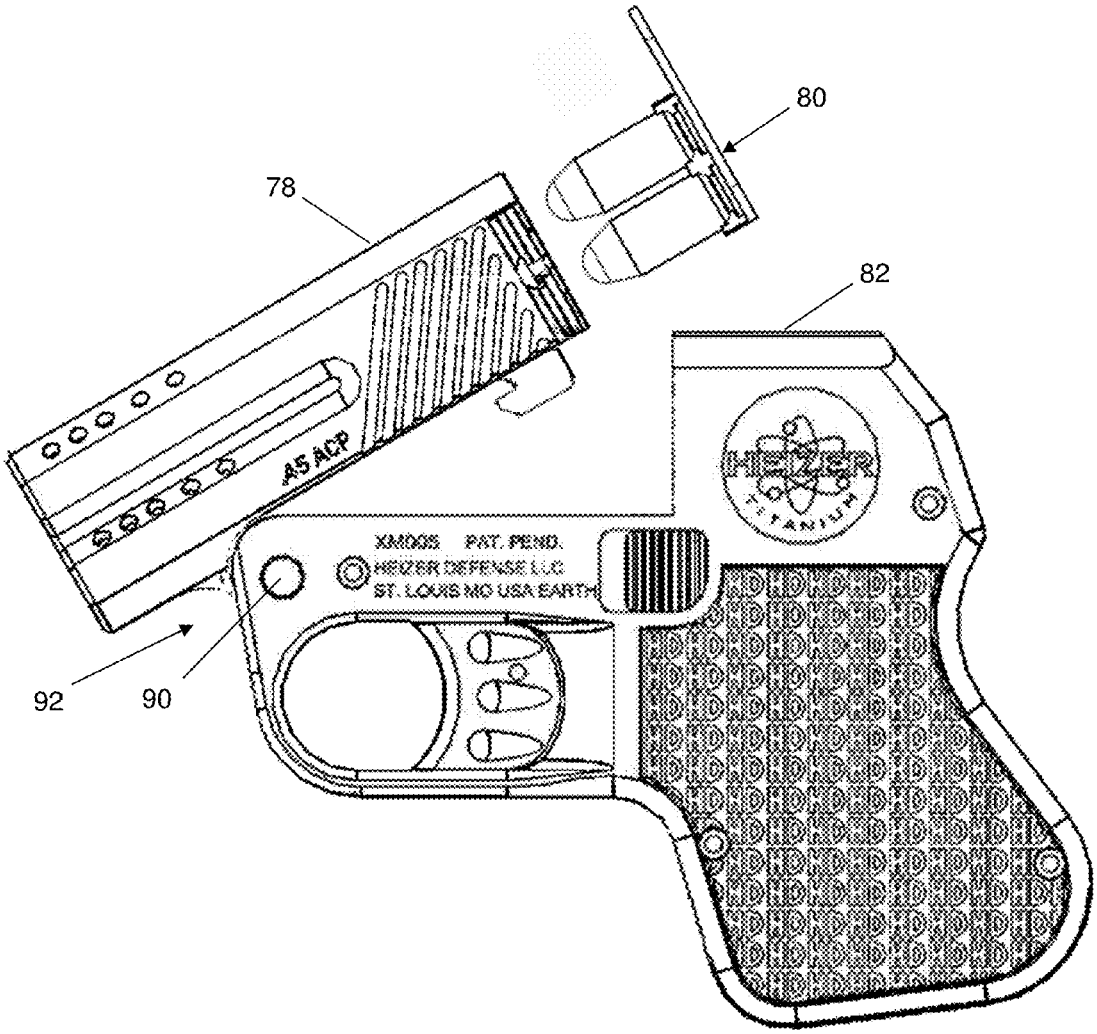
FIG. 5 is a side view of the firearm with an open barrel for loading cartridges.

An exemplary use of the ammunition storage compartment 14 is illustrated in FIG. 5. After the pistol 100 is fired, the empty shells are ejected from the barrel 78 or other firing chambers for the shells, and the latch 40 on the door 16 of the handle 10 is released to permit access to the spare ammunition 20 in the compartment 14. The strip clip 18 can serve as a speedloader 80 because the ammunition 20 can be pulled from the compartment 14 and loaded into the barrels 78 without being removed from the strip clip. As indicated above, the resilient tab 56 unfolds and protrudes from the bottom of the handle 10 when the door 16 is released and opened. The shooter pulls the tab 56 to extract the speedloader 80 with the cartridges 20 attached to the strip clip 20 and loads the firearm while the strip clip 18 is still attached to the cartridge shells. Once the cartridges are loaded in the gun, the speedloader is pulled away leaving the cartridges in their firing-ready position. For the particular firearm design shown in FIG. 5, the cartridges 20 are loaded into the barrel 78, and the firearm is ready to fire when the loaded double-barrel is closed on the firearm frame 82.

By securing the strip clip 18 within the grooves 34 in the compartment 14, different calibers of ammunition can be stored within the same cavity, such as described above with reference to the strip clips shown in FIGS. 4E and 4F. This can be helpful for a firearm with a frame 82 that can accommodate different caliber rounds 20. For example, in the particular embodiment in which the ammunition 20 is directly loaded into the barrel 78, different caliber barrels 78 can be mounted onto the frame 82, and the same compartment can be used for the different caliber ammunition 20 that correspond with the caliber of the barrels 78.

As shown in FIG. 6, the ammunition storage compartment 14 can also be used to store ammunition 20 that is held together by a combined storage-firing clip 84A. A storage-firing clip 84 is particularly useful for storing ammunition 20 that is to be loaded into firearms 100 that have multiple firing chambers, such as chambers in a revolver's firing cylinder or barrels in multi-barrel breech-loading firearms which may be a multi-barrel Deringer-style pistol or a double barrel shotgun or rifle. The storage-firing clips 84 can come in a number of different configurations that correspond with the configuration of the firearm's chambers. For example, storage-firing clips can be moon clips, including full-moon, half-moon and third-moon clips, H-clips, W-clips and any other configuration of clips holding multiple cartridges in the arrangement corresponding with the firearm's chambering mechanism. For example, the arrangement of moon clips in a circular or semi-circular shape corresponds with the radial arrangement of the chambers in the firing cylinder of revolvers. In comparison, the H-clip is particularly suited to correspond with the linear arrangement of double-barrel pistols, rifles and shotguns. For triple-barrel or four-barrel guns, various alternative arrangements of the clip correspond with the barrel arrangements. Different styles of H-clips 84A, 84B, 84C are shown in FIGS. 6 and 7A, and a full-moon clip 84D and third-moon clip 84E are shown in FIG. 7B. The storage compartment may have a groove 34 as described above and shown in FIGS. 1 and 2 or may have a smooth surface without any groove.

Figure 9A:
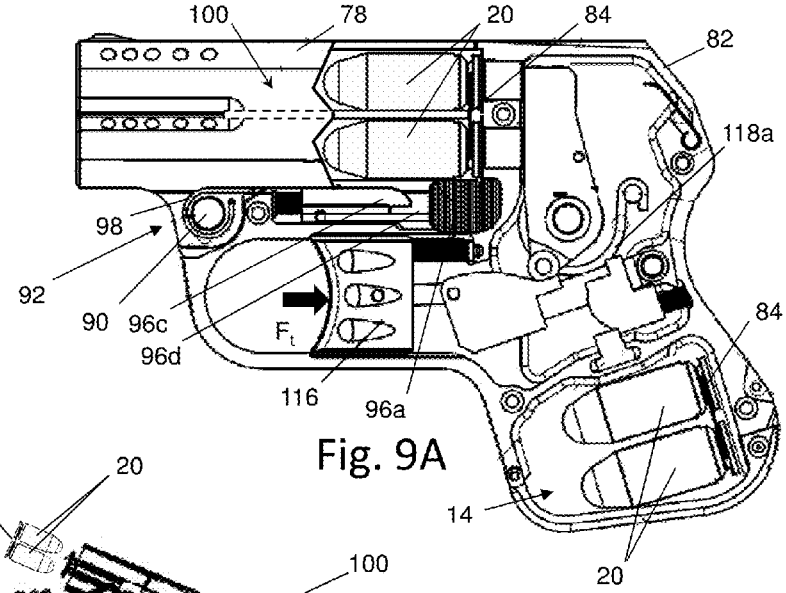
FIGS. 9A and 9B are side views of firearms with cartridges held together with storage-firing clips and respectively stored within a grip and a butt stock.
Figure 9B:
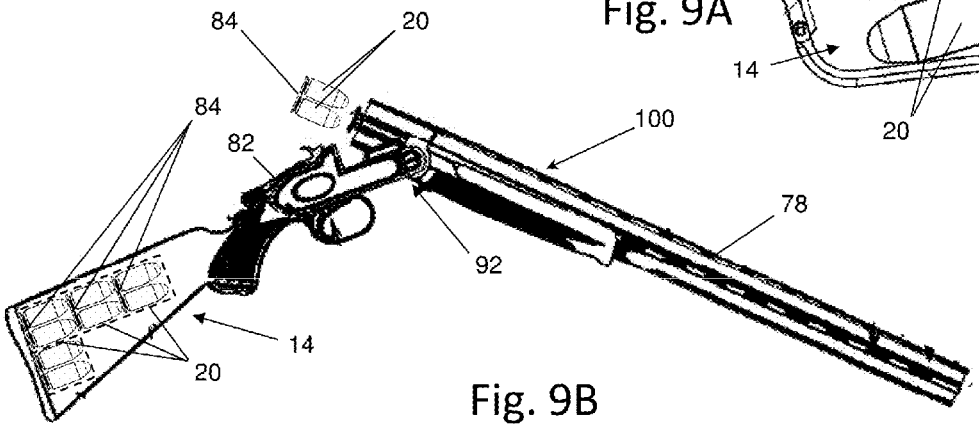

Regardless of the particular configuration, the storage-firing clips 84 are generally not considered a speedloader device because storage-firing clips 84 do not need to be removed from the ammunition when it is loaded and fired. As shown in FIG. 6, the storage-firing clips 84 secure the cartridges at the base of the cartridge casing proximate to the primer end of the rounds but do not cover the primer. In comparison, the speedloaders must be removed from the ammunition when it is loaded in order for it to be fired because speed loaders cover the primer and would prevent the loaded firing chambers from being closed with the speedloaders in place over the ammunition base. Accordingly, as shown in FIGS. 6, 8 and 9A, the ammunition 20 secured together with the H-clip 84A can be loaded into the barrels in the same configuration as they are stored in the ammunition compartment in the handle. A loading position is shown in FIGS. 5, 8 and 9B, and a firing-ready position is shown in FIGS. 1 and 9A.

The storage-firing clips 84 can be used for any type of cartridge, including shotgun shell rounds or bullet rounds for pistols or rifles. Additionally, the storage-firing clips can be used with ammunition that is stored in one or more chambers or compartments in the firearms' hand grips, forearm stocks or butt stocks and a porting system for the discharge of gases at points along the length of the barrel when the ammunition is fired, and is particularly suited for firearms with multiple chambers for the ammunition. For example, as shown in FIG. 9B, a series of multiple rounds secured with storage-firing clips are stored in the butt stock of a double barrel rifle. It will also be appreciated that the ammunition can be secured together with a storage-firing clip and loaded into the correspondingly-arranged chambers of a revolver's firing cylinder which may be a swing-out design or a top-break design (not shown).

Figure 10:
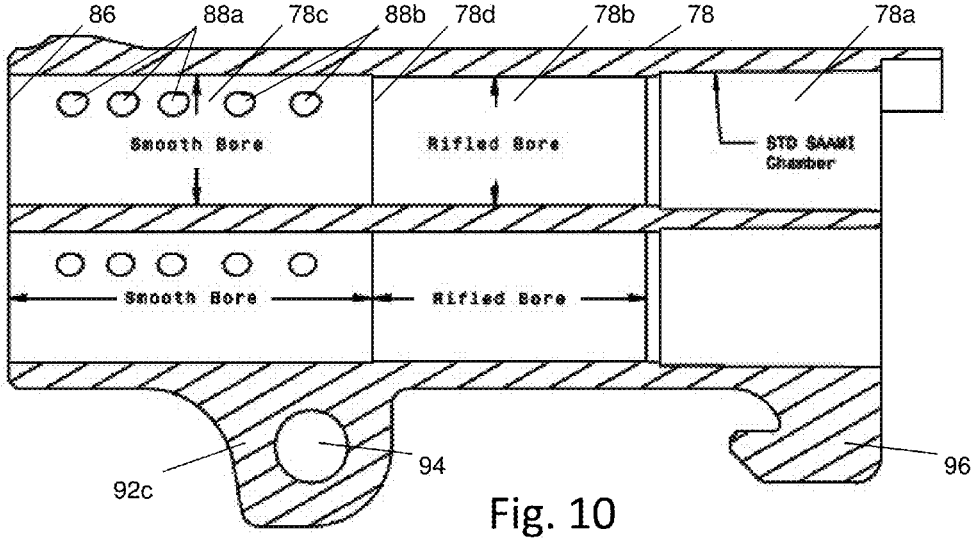
FIG. 10 is a cutaway side view of a barrel.

As particularly shown in FIG. 10, the barrel 78 preferably has a firing chamber section 78*a*, a rifled-bore section 78*b* adjacent to the chamber section, and a smooth-bore section 78*c* extending from a transition zone 78*d* at the interface with the rifled-bore section 78*b* to the barrel's muzzle 86. The smooth-bore section of the barrel is preferably formed with multiple sets of ports 88*a*, 88*b* whereas no ports are formed in the rifled bore section. The ports are progressively spaced, with one set of ports having one spacing distance between each other and another set of ports having another spacing distance that is greater than the spacing of the other ports. The closest port to the rifled-bore section is located a distance from the bore transition zone that is greater than the smallest spacing between the ports and is preferably located at a distance of the greatest port spacing. Additionally, the set of ports with the larger spacing is preferably located proximate to the bore transition zone with the set of ports with the smaller spacing located toward the muzzle. It is also preferred that the closest port to the bore transition zone is located a distance that is greater than one bore diameter.

The distribution of the ports 88 and their locations are designed to increase the velocity of the bullet travelling through the barrel 78 while reducing the muzzle climb from the kickback of the discharge. The location of the ports shown in FIG. 10 are optimized for a pistol. However, it will be appreciated that the combination of the port locations relative to the smooth-bore section and the rifled-bore section of the barrel can also be used in rifle barrels such as shown in FIG. 9B. Additionally, the progressive spacing of the ports can be beneficial for rifle barrels as well as pistol barrels.

Figure 11A:
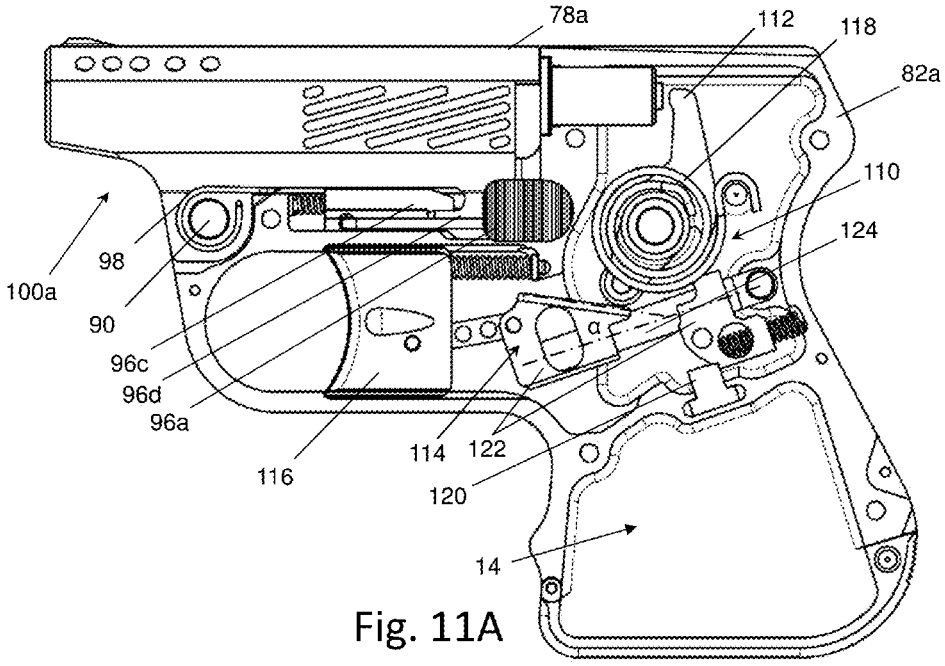
FIGS. 11A and 11B are cutaway side views showing the trigger mechanism.
Figure 11B:
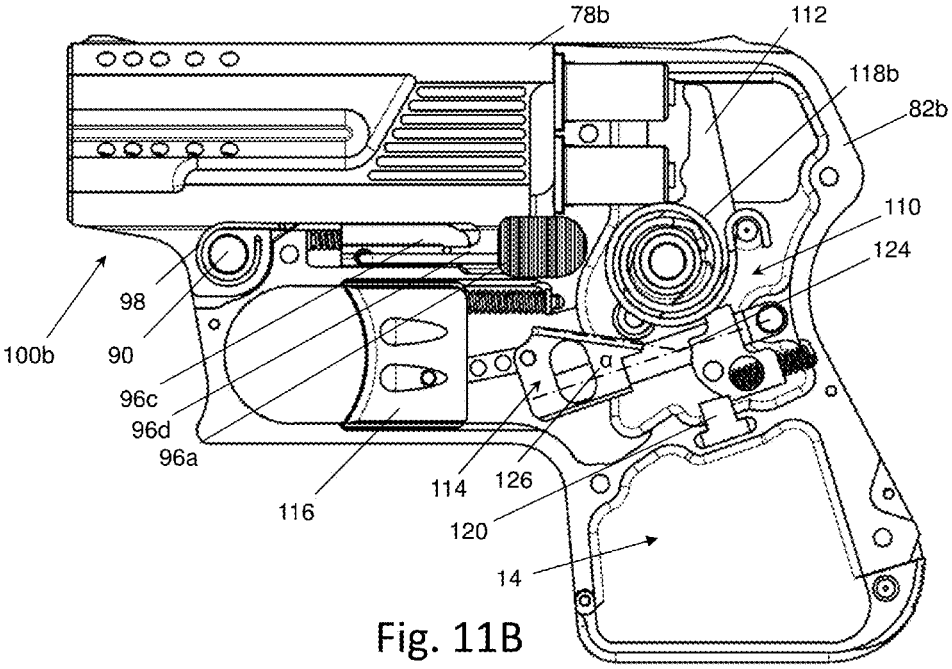

Another benefit of the barrel of the present invention is the use of a takedown pin 90 to rotatably secure interchangeable, variable-caliber barrels 78 to the same frame 82 with a top-break connection 92. The top-break connection 92 can be incorporated into a single-barrel arrangement 78*a*, 82*a* as shown in FIG. 11A or a multi-barrel arrangement 78*b*, 82*b* as shown in FIG. 11B. Prior firearms with interchangeable barrel systems required a tool to loosen the pin securing means or other fastener that would rotatably hold the barrel in the frame. In prior firearms, such a tool is not a feature or part of the standard operation of the firearm.

According to the present invention, the pivoting side of the top-break connection 92 has a pair of shoulders 92*a* on the frame 82 with a slot 92*b* between the shoulders that receives a flange 92*c* that extends from the barrel 78. The shoulders 92*a* the flange 92*c* have holes 94 that are aligned, and the takedown pin 90 has a smooth surface so it can be inserted into and extend through the aligned holes 94 with a friction fit to securely hold the barrel to the frame in a rotatable manner. The diameter of the aligned holes in the shoulders and the flange are preferably sized to receive the tip of one of the bullets that fits in the barrel so that the ammunition cartridge has sufficient clearance within the aligned holes to push said takedown pin from a seated position to an unseated position. To dislodge the takedown pin from its position between the shoulders, the tip of a bullet can be pressed against one end of the takedown pin so that it is pushed at least partially through the aligned holes with one end moved inside the aligned holes and the other end extending out of the other side of the aligned holes. Alternatively, one of the arms on the storage-firing clips can be used to push the takedown pin substantially through the aligned holes as shown in FIG. 8.

Accordingly, with the present invention, the features that are used as a part of the standard operation of the firearm can also be used as the tool to dislodge the takedown pin and interchange barrels. In this way, different barrels, including barrels having different calibers, can be rapidly interchanged by simply removing the "tool-less" takedown pin, aligning the barrel's flange between the shoulders, and reinserting the takedown pin.

According to the present invention, the rotating side of the top-break connection 96 has a spring-loaded thumb latch 96*a* slides in a groove 96*b* that is recessed from the surface of the frame. The thumb latch 96*a* actuates an internal catch 96*c* that engages and secures a hook 96*d* which extends from the bottom of the barrel. When the thumb latch disengages the internal catch from the hook, a torsion spring 98 that wraps around the takedown pin and is fitted between the frame and the barrel forces the barrel to rotate around the pivoting side of the top-break connection 92.

As shown in FIGS. 9A, 10A and 10B, a trigger mechanism 110 is fixed within the firearm's frame 82. In particular, a hammer 112, sear assembly 114 and trigger pull 116 are positioned in a pistol frame 82. The hammer 112 has a pivot point between its striking end that extends towards the breech plate and a cam end that contacts the sear 114. A hammer spring 118 biases the hammer 112 in a seated position against the breech plate. The sear assembly 114 and trigger pull 116 operate in combination with each other and to rotate the hammer into its cocked position and to release the hammer so that the hammer spring snaps it back to its seated position in a striking action. The sear 114 is supported by a disconnect rest 120 while the trigger pull 116 forces the sear from its rest position to its break point position. The trigger pull 116 pushes the sear past its break point position and the hammer spring forces the sear to its disconnect position.

As respectively illustrated in FIGS. 11A and 11B, the trigger mechanism 110 can be incorporated into a single-barrel 78*a* firearm 100*a* or a multi-barrel 78*b* firearm 100*b*. Although pistols are shown in these drawings, it will be appreciated that the trigger mechanism can be used in other firearms, particularly including rifles and shotguns such as shown in FIG. 9B. Additionally, while the frames 82*a*, 82*b* shown in the drawings are breech loading firearms 100*a*, 100*b*, it will be appreciated that the trigger mechanism can be combined with known ratcheting mechanisms for revolvers and can be incorporated into a semi-automatic firearm which reloads through a magazine clip (not shown).

The use of the trigger mechanism 110 according to the present invention is shown in FIGS. 11A and 11B with alternative single-barrel and double-barrel firearms that can fire a shotgun shell or another round, such as a 0.410 shotgun shell or a 0.45 Colt cartridge. In this embodiment, the firearm can shoot either caliber one at a time, and as discussed in detail above, the use of the tool-less takedown pin with interchangeable barrels allows the firearm 100 to be converted from one caliber to another very quickly. By opening the barrel 78 after the discharge, the shell can be automatically ejected or the shell could be manually extracted. The storage-firing clips 84 described above held with the manual extraction of shells.

For the multi-barrel embodiments described above, it will also be appreciated that various indexing mechanisms can be incorporated into the hammer 112 so that sequentially pulling the trigger 116 will cause the hammer to first strike the firing pin of the shell in one barrel 78*a* and subsequently strike the firing pin of the shell(s) in the other barrel(s) 78*b*. As respectively shown in FIGS. 9A and 11B, the hammer spring 118 may be a torsion spring 118*a* or a coil spring 118*b*.

The sear assembly 114 is preferably formed by a block assembly 122 that is slidingly arranged on a guide rod 124. The block assembly 122 preferably includes a wedge block and a disconnect block that each has a central passage that is positioned on and slides relative to the guide rod 124. The guide rod 124 has a pivoting end and a distal end that can rotate relative to the pivoting end which is fixed to the frame 82. The wedge block is supported by the guide rod 124 at its distal end, and is connected to the trigger pull 116 through an arm that has a rotating joint at each end. The disconnect block is positioned on the guide rod 124 between the pivoting end and the wedge block and supports the other elements in the sear assembly 114, namely the guide rod 124 which in turn supports the wedge block. The angle ($\alpha$) between the plane of the hammer side and the plane of support side forms a wedge 126 which, along with the spring constant ($k_h$) of the hammer spring 118, and to a lesser degree the spring constant ($k_t$) of the trigger return spring, defines the force ($F_t$) that is necessary to pull the trigger.

The embodiments were chosen and described to best explain the principles of the invention and its practical application to persons who are skilled in the art. As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. For example, although the preferred embodiment positions the open section of the grip and the door at the butt end of the handle, it will also be appreciated that the open section and door could be at the palm side of the handle or the finger side of the handle without departing from the scope of the present invention. Thus, the breadth and scope of the present invention should not be limited by any of the above-described exemplary embodiments, but should be defined only in accordance with the following claims appended hereto and their equivalents.

What is claimed is:

1. A firearm for shooting ammunition cartridges, comprising:

a frame comprising a trigger mechanism and at least one of a butt stock and a handle, wherein said trigger mechanism further comprises a block assembly slidingly arranged on a guide rod and a hammer having a striking end, a cam end opposite from said striking end, and a pivot point between said striking end and said cam end, wherein said block assembly further comprises a wedge block, a disconnect block and a disconnect rest, wherein said wedge block slides from a first position at a distal end of said guide rod to a second position in contact with said disconnect block, and wherein said cam end of said hammer engages said wedge block and forces said hammer to rotate about said pivot point as said wedge block slides from said first position to said second position;

a barrel assembly operatively connected to said frame, wherein said barrel assembly is comprised of a plurality of barrels and a plurality of firing chambers having a first arrangement, wherein each of said firing chambers is located in a breech end of a corresponding one of said barrels, wherein said firing chambers have a loading position and a firing-ready position; wherein said breech end of said barrels rotates away from said frame to place said firing chambers in said loading position, and wherein said breech end of said barrels rotates toward said frame to place said firing chambers in said firing-ready position;

a storage-firing clip having a second arrangement corresponding with said first arrangement of said firing chambers in said corresponding barrels; and a compartment situated within said frame, wherein the ammunition cartridges are secured together by said storage-firing clip within said compartment and are fitted into said firing chambers while said firing chambers are in said loading position, and wherein said firing chambers move from said loading position to said firing-ready position with the ammunition cartridges secured together by said storage-firing clip within said firing chambers.

2. The invention of claim 1, wherein said compartment is located in said butt stock of at least one of a rifle and a shotgun.

3. The invention of claim 1, wherein said compartment is located in said handle of at least one of a multi-barrel, breech-loader pistol and a multi-barrel, breech-loader shotgun.

4. The invention of claim 1, wherein said storage-firing clip is selected from the group of clips consisting of an H-clip, a W-clip, and a moon clip.

5. The invention of claim 1, wherein said compartment has at least one of a smooth sidewall and a grooved sidewall.

6. The invention of claim 1, wherein each of said barrels in said barrel assembly has a smooth-bore section and a rifled-bore section, and wherein a plurality of ports are provided in said smooth-bore section and no ports are in said rifled-bore section.

7. The invention of claim 6, wherein a closest port to a bore transition zone between said smooth-bore section and said rifled-bore section is located a distance from said bore transition zone that is greater than one bore diameter.

8. The invention of claim 6, wherein a first set of said ports has a first spacing between each other and a second set of said ports has a second spacing between each other, wherein said second spacing is greater than said first spacing and wherein a closest port to a bore transition zone between said smooth bore section and said rifled bore section is located a distance from said bore transition zone that is greater than said first spacing.

9. The invention of claim 1, wherein said barrel assembly further comprises a hook and said frame further comprises a thumb latch in a recessed groove and an internal catch, wherein said internal catch engages said hook.

10. The invention of claim 9, wherein said frame further comprises a torsion spring fitted between said frame and said barrel assembly, wherein said engagement between said internal catch and said hook secures said barrel assembly to said frame in a firing-ready position and wherein said torsion spring forces said barrel assembly to rotate away from said frame to said loading position.

11. The invention of claim 1, wherein said barrel assembly further comprises a flange and said frame further comprises a pair of shoulders and a slot between said shoulders, wherein said flange and said pair of shoulders comprise aligned holes, and wherein said flange extends into said slot.

12. The invention of claim 11, further comprising a takedown pin extending through said aligned holes with a friction fit and securely holding said barrel assembly to the frame in a rotatable manner.

13. The invention of claim 12, wherein at least one of said storage-firing clip and the ammunition fit within said aligned holes and pushes said takedown pin from a seated position between said shoulders to an unseated position wherein one end of said takedown pin is moved inside said hole in a first of said shoulders toward said flange and another end of said takedown pin extends out of said hole in a second of said shoulders.

14. A firearm for shooting ammunition cartridges, comprising:

a frame comprising a trigger mechanism, at least one of a butt stock and a handle, a thumb latch in a recessed groove, an internal catch, a pair of shoulders wherein each of said shoulders has an aligned hole, and a slot between said shoulders, wherein said trigger mechanism is comprised of a hammer and a block assembly slidingly arranged on a guide rod, said hammer comprising a striking end, a cam end opposite from said striking end, and a pivot point between said striking end and said cam end, said block assembly comprising a wedge block, a disconnect block and a disconnect rest, wherein said wedge block slides from a first position at a distal end of said guide rod to a second position in contact with said disconnect block, and wherein said cam end of said hammer engages said wedge block and forces said hammer to rotate about said pivot point as said wedge block slides from said first position to said second position;

a barrel assembly operatively connected to said frame, wherein said barrel assembly comprises a hook engaging said internal catch and a flange extending from said barrel assembly into said slot between said shoulders in said frame, and wherein said flange has a hole aligned with each aligned hole in said shoulders;

a takedown pin having a smooth surface and extending through said aligned holes with a friction fit and securely holding said barrel assembly to the frame in a rotatable manner, wherein a diameter of said aligned holes are sized to receive the tip of one of the ammunition cartridges that fits in said barrel assembly, the ammunition cartridge having sufficient clearance within said aligned holes to push said takedown pin from a seated position between said shoulders to an unseated position, wherein one end of said takedown pin is moved inside said hole in a first of said shoulders toward said flange and another end of said takedown pin extends out of said hole in a second of said shoulders;

a compartment situated within said frame; and a storage-firing clip securing the ammunition cartridges together within said compartment, wherein said storage-firing clip is comprised of a plurality of rigid arms, wherein at least one of said arms has sufficient clearance within said aligned holes to push said takedown pin from a seated position between said shoulders to an unseated position.

15. The invention of claim 14, wherein said barrel assembly comprises a plurality of barrels a plurality of firing chambers having a first arrangement, wherein each of said firing chambers is located in a breech end of a corresponding one of said barrels, wherein said firing chambers have an ammunition-loading position and a firing-ready position, wherein said frame further comprises a torsion spring fitted between said frame and said barrel assembly, wherein said engagement between said internal catch and said hook secures said barrel assembly to said frame in said firing-ready position and wherein said torsion spring forces said barrel assembly to rotate away from said frame to said ammunition-loading position.

16. The invention of claim 15, wherein the ammunition cartridges are secured together by said storage-firing clip and are fitted into said firing chambers while said firing chambers are in said ammunition-loading position, and wherein said firing chambers move from said loading position to said firing-ready position with the ammunition cartridges secured together by said storage-firing clip within said firing chambers, and wherein said storage-firing clip has a second arrangement corresponding with said first arrangement of said firing chambers.

17. The invention of claim 14, wherein said barrel assembly has a smooth-bore section and a rifled-bore section, wherein a plurality of ports are provided in said smooth-bore section and no ports are in said rifled-bore section, wherein a first set of said ports has a first spacing between each other and a second set of said ports has a second spacing between each other, wherein said second spacing is greater than said first spacing and wherein a closest port to a bore transition zone between said smooth bore section and said rifled bore section is located a distance from said bore transition zone that is greater than said first spacing.

18. A firearm for shooting ammunition cartridges, comprising:

a frame comprising a trigger mechanism, at least one of a butt stock and a handle, a thumb latch in a recessed groove, an internal catch, a pair of shoulders wherein each of said shoulders has an aligned hole, and a slot between said shoulders, wherein said trigger mechanism further comprises a hammer, a block assembly, and a hammer spring forcing said hammer into engagement with said block assembly, wherein said hammer has a striking end, a cam end opposite from said striking end, and a pivot point between said striking end and said cam end, wherein said block assembly is slidingly arranged on a guide rod and comprises a wedge block, a disconnect block and a disconnect rest, wherein said wedge block slides from a first position at a distal end of said guide rod to a second position in contact with said disconnect block, and wherein said cam end of said hammer engages said wedge block and forces said hammer to rotate about said pivot point against the force of said hammer spring as said wedge block slides from said first position to said second position, wherein said frame further comprises a torsion spring fitted between said frame and said barrel assembly, wherein said engagement between said internal catch and said hook secures said barrel assembly to said frame in said firing-ready position and wherein said torsion spring forces said barrel assembly to rotate away from said frame to said loading position;

a barrel assembly operatively connected to said frame, wherein said barrel assembly is comprised of a plurality of barrels and a plurality of firing chambers having a first arrangement, wherein each of said firing chambers is located in a breech end of a corresponding one of said barrels, wherein said firing chambers have a loading position and a firing-ready position, wherein said barrel assembly comprises a hook engaging said internal catch and a flange extending from said barrel assembly into said slot between said shoulders in said frame, wherein said flange has a hole aligned with each aligned hole in said shoulders, wherein said breech end of said barrels rotates away from said frame to place said firing chambers in said loading position, and wherein said breech end of said barrels rotates toward said frame to place said firing chambers in said firing-ready position;

a storage-firing clip having a second arrangement corresponding with said first arrangement of said firing chambers in said corresponding barrels;

a compartment situated within said frame, wherein the ammunition cartridges are secured together by said storage-firing clip within said compartment and are fitted into said firing chambers while said firing chambers are in said loading position, and wherein said firing chambers move from said loading position to said firing-ready position with the ammunition cartridges secured together by said storage-firing clip within said firing chambers; and a takedown pin having a smooth surface and extending through said aligned holes with a friction fit and securely holding said barrel assembly to the frame in a rotatable manner between said firing-ready position and said loading position, wherein a diameter of said aligned holes are sized to receive the tip of one of the ammunition cartridges that fits in said barrel assembly, the ammunition cartridge having sufficient clearance within said aligned holes to push said takedown pin from a seated position between said shoulders to an unseated position wherein one end of said takedown pin is moved inside said hole in a first of said shoulders toward said flange and another end of said takedown pin extends out of said hole in a second of said shoulders.

19. The invention of claim 18, wherein each one of said barrels in said barrel assembly has a smooth-bore section and a rifled-bore section, wherein a plurality of ports are provided in said smooth-bore section and no ports are in said rifled-bore section, wherein a closest port to a bore transition zone between said smooth-bore section and said rifled-bore section is located a distance from said bore transition zone that is greater than one bore diameter, wherein a first set of said ports has a first spacing between each other and a second set of said ports has a second spacing between each other, wherein said second spacing is greater than said first spacing and wherein a closest port to said bore transition zone between said smooth bore section and said rifled bore section is located from said bore transition zone at a distance that is selected from a group of distances consisting of a distance greater than said first spacing, a distance from said bore transition zone that is greater than said first spacing, and any combination thereof.

20. The invention of claim 18, wherein said storage-firing clip is selected from the group of clips consisting of an H-clip, a W-clip, and a moon clip.

* * * * *